US005445557A

United States Patent [19]

Gramm et al.

[11] Patent Number: 5,445,557

[45] Date of Patent: Aug. 29, 1995

[54] ABRASIVE BLASTING FLOOR RECOVERY SYSTEM WHICH IS RESISTANT TO CLOGGING

[75] Inventors: John A. Gramm; Gerald L. Overby, both of Tucson, Ariz.

[73] Assignee: Stripping Technologies, Inc., Tucson, Ariz.

[21] Appl. No.: 127,777

[22] Filed: Sep. 27, 1993

[51] Int. Cl.[6] ..... B24C 3/00

[52] U.S. Cl. ..... 451/75; 209/223.1; 451/88; 451/87

[58] Field of Search ..... 51/410, 424, 425, 426, 51/427; 406/121, 122; 209/38, 636, 223.1

[56] References Cited

U.S. PATENT DOCUMENTS

| | | | |
|---|---|---|---|
| 1,458,341 | 6/1923 | Herbert | 406/121 |
| 2,594,072 | 4/1952 | Ridley | 51/410 |
| 3,323,647 | 6/1967 | Ogden et al. | 209/223.1 |
| 3,487,766 | 1/1970 | Wood . | |
| 3,512,469 | 5/1970 | Temple et al. . | |
| 3,638,404 | 2/1972 | Moll et al. . | |
| 3,657,991 | 4/1972 | Oberg . | |
| 3,672,292 | 6/1972 | Arnold . | |
| 3,863,392 | 2/1975 | Haker . | |
| 3,942,964 | 3/1976 | Shuler . | |
| 5,035,089 | 7/1991 | Tillman et al. | 51/425 |
| 5,103,981 | 4/1992 | Abbott et al. . | |
| 5,216,848 | 6/1993 | Abbott et al. . | |
| 5,231,804 | 8/1993 | Abbott . | |
| 5,316,151 | 5/1994 | Thompson | 209/223.1 |

FOREIGN PATENT DOCUMENTS

| | | | |
|---|---|---|---|
| 0030379 | 2/1986 | Japan | 51/410 |

*Primary Examiner*—Bruce M. Kisliuk
*Assistant Examiner*—Derris H. Banks
*Attorney, Agent, or Firm*—Ogram & Teplitz

[57] ABSTRACT

An improved hopper and conveyance tube combination which is resistant to clogging and more easily loaded. Material is delivered from the hopper and into the conveyance tube through an inlet opening in the side of the conveyance tube. Because the inlet opening is in the side of the conveyance tube, the tube can not become completely clogged. Air or conveying fluid is always able to move through the conveyance tube and eventually conveys all of the materials to the desired destination. A ramp connected to the rim of the hopper permits materials on the floor to be easily swept up the ramp and into the hopper.

14 Claims, 4 Drawing Sheets

ABRASIVE BLASTING FLOOR RECOVERY SYSTEM WHICH IS RESISTANT TO CLOGGING

BACKGROUND OF INVENTION

This invention relates generally to hoppers and more specifically to floor recovery systems for use with abrasive blasting systems.

Hoppers are well known in the art. Generally, hoppers are funnel shaped receptacles used for the temporary storage and delivery of materials. An opening in the bottom of the hopper allows the materials to be dispensed or delivered as needed. Hoppers have long been used for storage and delivery of materials such as coal, grains, ore, gravel, abrasive blasting media, and many other materials.

A conventional hopper connected to a conveyance tube is shown in FIG. 1. The operation of the hopper and conveyance tube are quite simple. Materials are shoveled into the hopper which gradually delivers the materials into the top of the conveyance tube via the outlet opening in the bottom of the hopper. A blower or vacuum means(not shown) induces airflow in the conveyance tube thus transporting the materials away from the hopper, through the conveyance tube, and to a desired destination.

One particular application of hoppers is in conjunction with abrasive blasting systems. In abrasive blasting, a gas or liquid under pressure(sometimes referred to as medium) is used to propel material(sometimes referred to as media) through a hose which is directed at a target. This process has long been used for removing paints and other coatings from a surface, removing rust, cutting substrates, and the like.

A result of this process is that large amounts of used media accumulate on the floor of the work area. Since most of this media can be recycled and used again, the media, along with some contaminants, is swept into piles and shoveled into a hopper connected to a conveyance tube as described earlier.

There are at least two disadvantages with this system of recovering used media. First, hoppers and conveyance tubes frequently become clogged. As large amounts of media are shoveled into the hopper, media often builds up in the conveyance tube until the tube is completely blocked. The blockage must be removed before more media can be processed, thus causing delays and down time of the system. Secondly, shoveling media into a hopper by hand is an inefficient means of conveying media from the floor and into the hopper.

Clearly, there exists a need for an improved floor recovery/hopper system which does not clog and does not require material to be shoveled into a recovery hopper by hand.

SUMMARY OF INVENTION

The invention creates an improved hopper and conveyance tube combination which is resistant to clogging and is more easily loaded.

The clog resistant characteristic of the invention is achieved by simply repositioning the inlet opening of the conveyance tube. In the prior art, inlet openings were simply located in the top of the conveyance tube. This design worked satisfactorily most of the time. However, if materials entered the conveyance tube at a faster rate than the conveying fluid could carry them away, the materials would accumulate in the conveyance tube under the inlet opening. As more materials accumulated, less conveying fluid is able to move through the tube to remove the materials and consequently even more materials accumulate. Finally, the tube would be completely blocked with materials and the movement of the conveying fluid would stop. At this point, an operator must intervene to unclog the conveyance tube.

In the current invention, the conveyance tube is much less likely to become completely blocked and the conveying fluid is thus able to continue to convey materials through the tube at all times. The invention places the inlet opening in the side of the conveyance tube or, more generally, it places the inlet opening below the top of the conveyance tube. With this design, materials stop flowing into the conveyance tube once the tube is filled to the level of the inlet opening. This assures that the conveyance tube is never completely filled or clogged due to the in-flow of materials. It also assures that some conveying fluid is always able to flow through the conveyance tube. Since the conveying fluid continues to flow, the accumulated materials are eventually carried away by the conveying fluid. In other words, the invention prevents excessive accumulations of material in the conveyance tube.

A second aspect of the invention is the sweep ramp. A ramp extends from the floor up to the rim of the hopper where it attaches. The ramp permits materials on the floor to be easily swept up the ramp and into the hopper. This eliminates the need of shoveling materials into the hopper as was common in the prior art.

Several embodiments of the invention are illustrated in the figures and described more fully below.

FIGS. *7a*, *7b*, and *7c* show several embodiments of conveyance tubes or channels.

Figure 8:
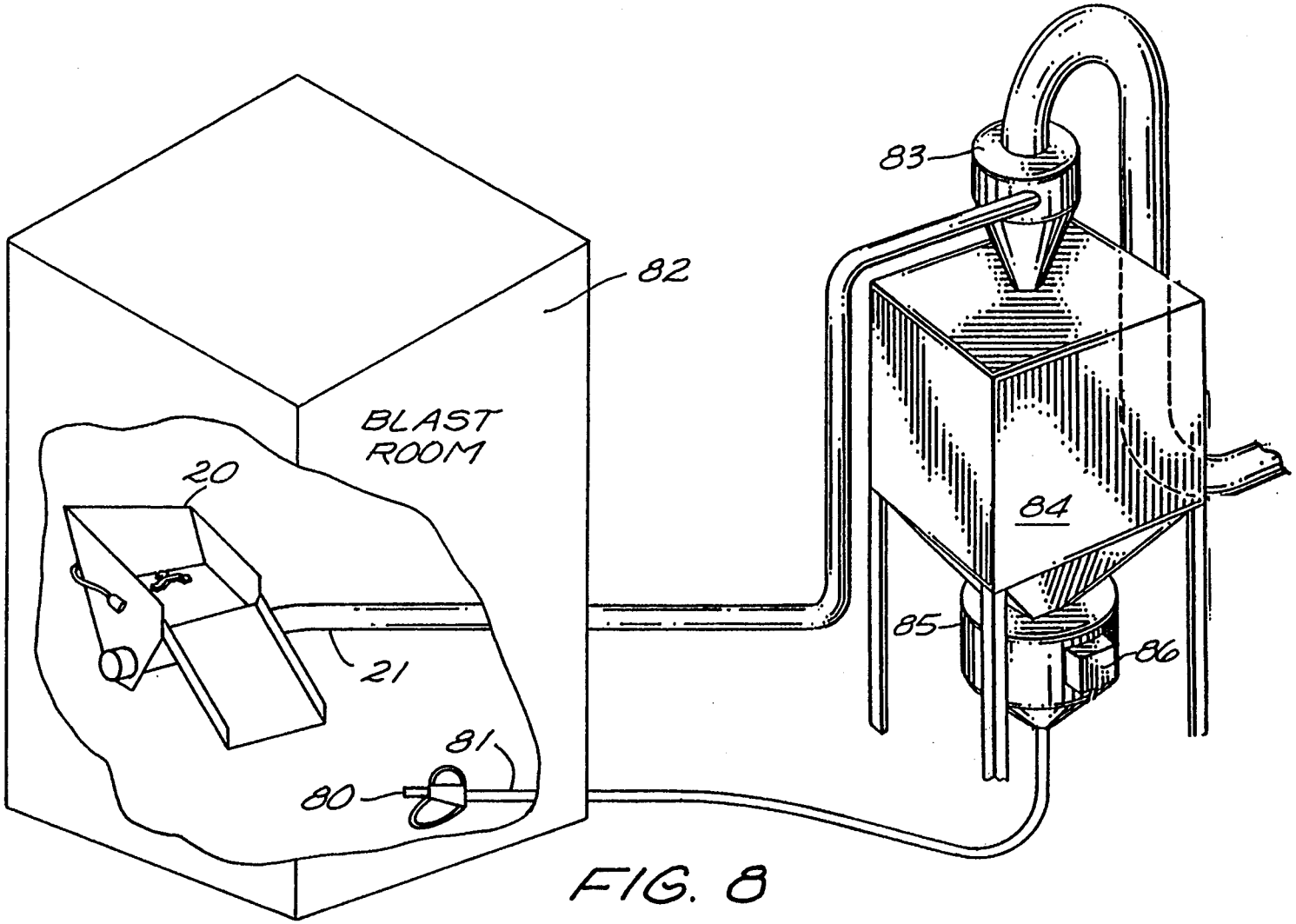

FIG. 8 shows the invention in combination with an abrasive blasting system.

DETAILED DESCRIPTION OF THE DRAWINGS

Figure 1:
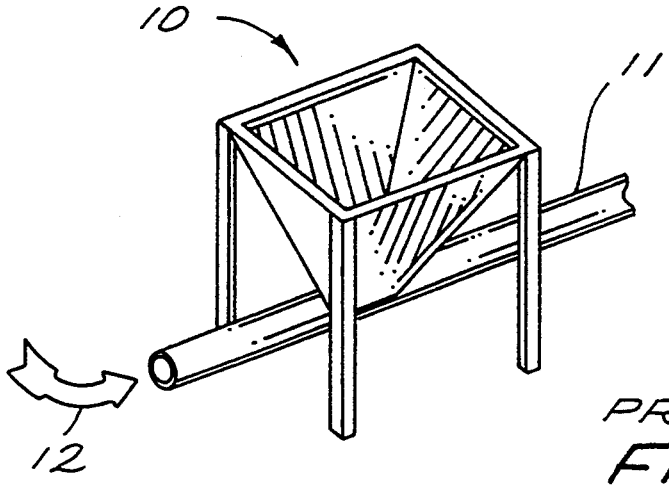
PRIOR ART FIG. 1
FIG. 1 is a perspective view of the prior art.

FIG. 1 shows the prior art. Materials are deposited into hopper 10. Hopper 10 delivers the materials into the top of conveyance tube 11. A blowing or suction means (not shown) induces airflow through conveyance tube 11 as shown by air 12 being drawn into conveyance tube 11. Airflow in the conveyance tube 11 transports materials from hopper 10 to a desired location.

Figure 2:
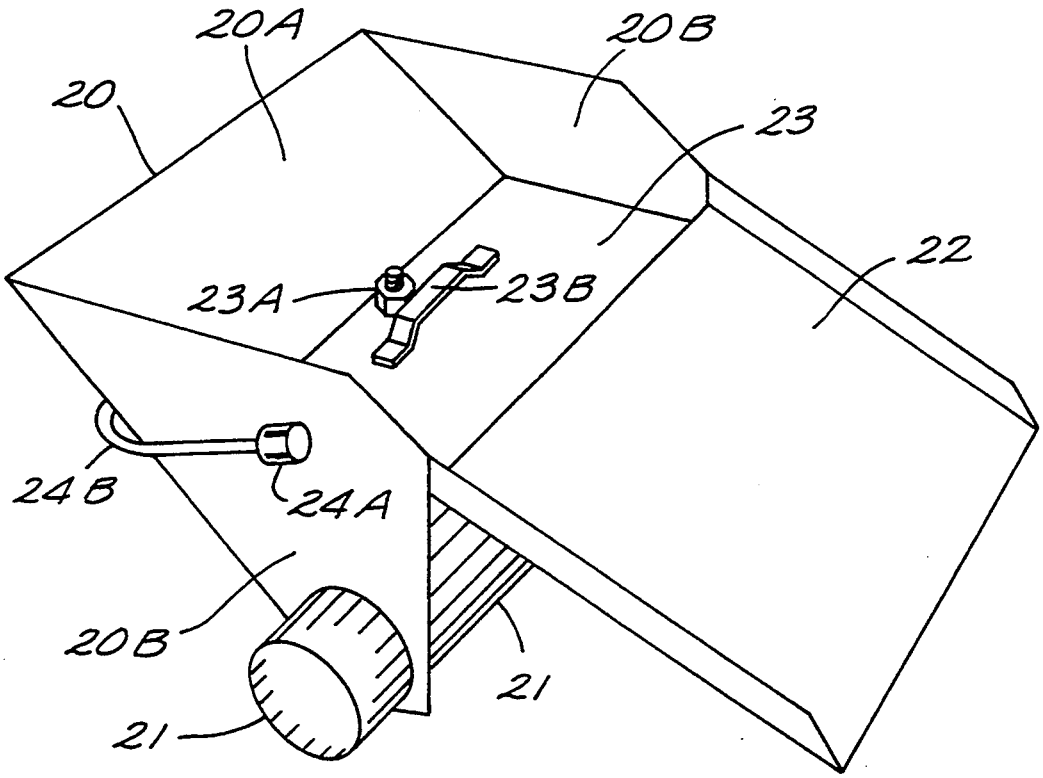
FIG. 2 is a perspective view of the preferred embodiment of the invention.

FIG. 2 is a perspective view of the preferred embodiment of the invention. Hopper 20 is combined with conveyance tube 21. Other components include ramp 22, screen 23, air coupling 24A, and air hose 24B. Hopper 20 includes a rear panel 20*a*, two side panels 20*b*, and a front panel(not shown) all of which comprise the sides of hopper 20.

Material is swept up ramp 22 and into hopper 20. Ramp 22 merely hooks over the rim(not shown) of hopper 20. Ramp 22 is easily removed from hopper 20 for moving, cleaning, and storage.

Screen 23 allows most materials to pass through, but retains particles larger than a predetermined size. Screen 23 is easily removed from hopper 20 by loosening retaining nut 23A and lifting on screen handle 23B. Screen 23 is made from any of the commonly know screening materials that will accomplish the desired screening purpose.

Hopper 20 temporarily holds the materials which are to be conveyed by conveyance tube 21. An outlet opening(not shown) in the bottom of hopper 20 is in communication with an inlet opening(not shown) of conveyance tube 21.

A vibration device(not shown) vibrates the entire apparatus and facilitates the movement of materials through the hopper 20 and into conveyance tube 21.

Figure 3:
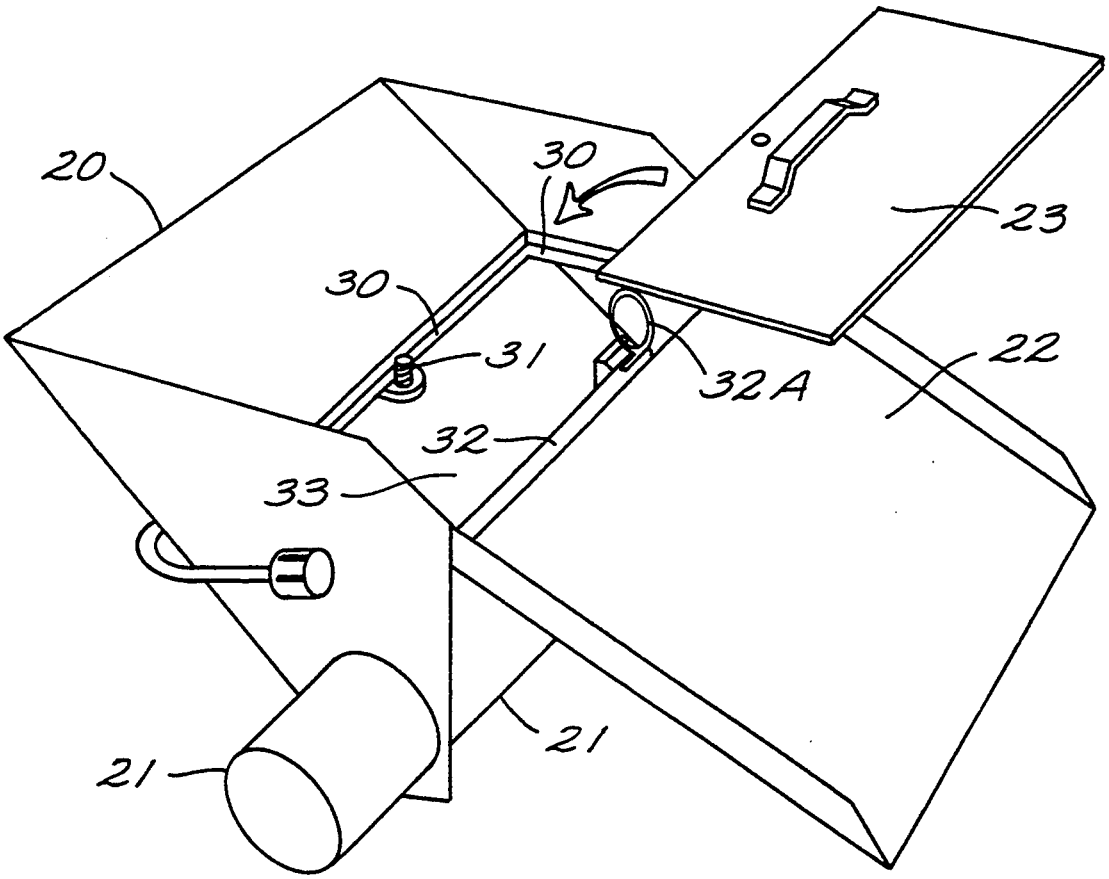
FIG. 3 shows the preferred embodiment with the screen removed.

FIG. 3 shows the invention with screen 23 removed. With screen 23 removed, screen support ledge 30, screen retaining bolt 31, magnet 32, and the bottom portion 33 of hopper 20 are revealed.

Magnet 32 is preferably a permanent magnet of sufficient size and length so that it substantially covers the outlet opening(not shown) of hopper 20. Magnet 32 rests on supports(not shown) a slight distance above the outlet opening. The purpose of magnet 32 is to attract and retain metallic particles which are mixed with the material. To accomplish this purpose, magnet 32 is positioned proximate to the outlet opening so that all ferrous material exiting hopper 20 passes sufficiently close to magnet 32 to be retained by magnet 32. Magnet 32 is easily removed for cleaning by grasping magnet handle 32A and lifting magnet 32.

Figure 4:
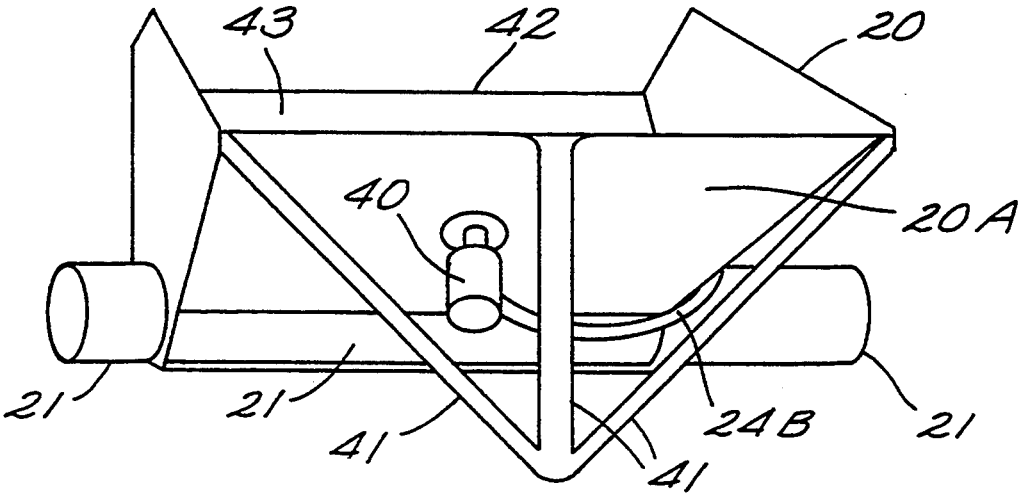
FIG. 4 is a rear view of the invention.

FIG. 4 is a rear view of the preferred embodiment of the invention. This view shows vibration device 40, support legs 41, rim 42 of hopper 20, and front panel 43.

Vibration device 40 is attached to the back side of rear panel 20A. Vibration device 40 is powered by pressurized air supplied by air hose 24B. The purpose of vibration device 40 is to vibrate the entire hopper/conveyance tube assembly and facilitate movement of the material therein. Vibration device 40 is any type of vibration inducing device commonly known in the art and is attached to any part of the hopper 20 or conveyance tube 21 such that it can perform the stated purpose. Alternately, vibration device 40 is powered by other power sources such as electricity.

Support legs 41 provide support for hopper 20 and prevent it from tipping over. Those skilled in the art readily see many alternate embodiments for support legs which are equivalent.

The ramp is removed from this figure thus exposing rim 42 of the front panel 43 of hopper 20.

Figure 5:
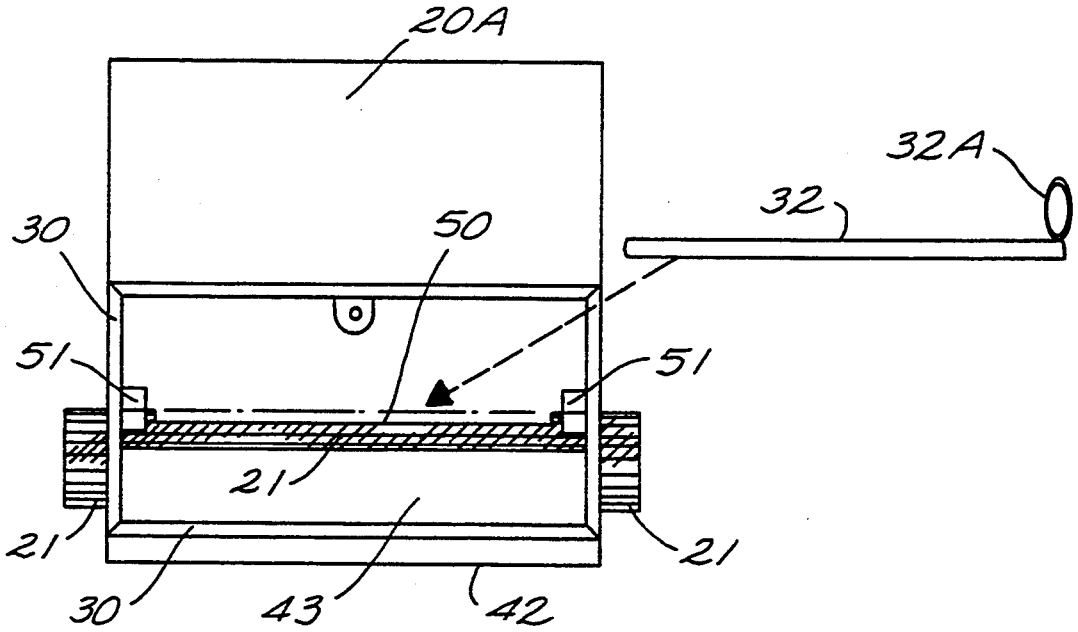
FIG. 5 is a top view showing the outlet opening of the hopper and the removable magnet.

FIG. 5 is a top view of the invention. Shown in this view are outlet opening 50 and magnet supports 51.

Outlet opening 50 is shown as a substantially rectangular opening in the bottom 33 of hopper 20. In this preferred embodiment, conveyance tube 21 actually forms a portion of the bottom of hopper 20. Therefore, in this embodiment, the outlet opening 50 of the hopper 20 and the inlet opening of the conveyance tube 21 are actually one in the same.

Magnet supports 51 support magnet 32 slightly above outlet opening 50. Magnet 32 rests on magnet supports 51 and is held in place by gravity and by magnet attraction between magnet 32 and the steel magnet supports 51.

Figure 6:
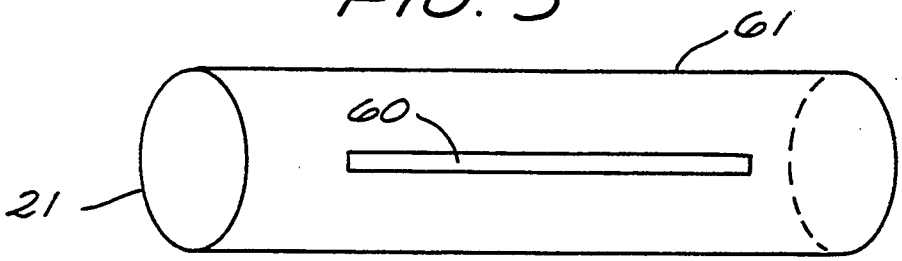
FIG. 6 shows the conveyance tube and the inlet opening.
Figures 7A, 7B, 7C:
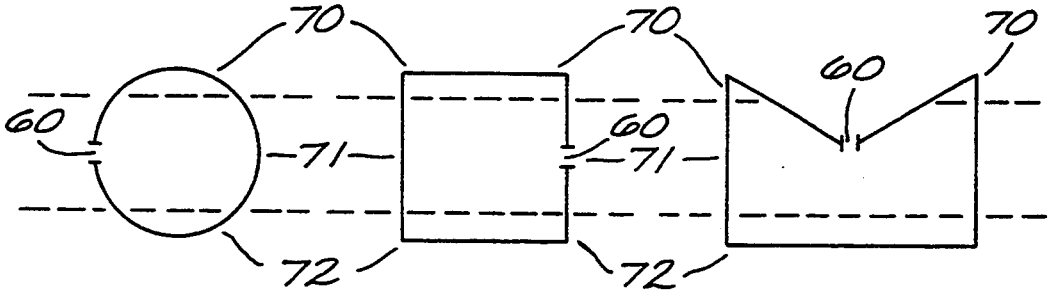

FIG. 6 shows a conveyance tube 21 in isolation. Inlet opening 60 (which in the preferred embodiment is one in the same with outlet opening 50 of hopper 20) is located on the side of conveyance tube 21. Inlet opening 60 must be below the top portion 61 of conveyance tube 21 for the invention to operate properly.

FIGS. *7a*, *7b*, and *7c* show three alternate embodiments of conveyance tubes or conveyance channels.

Each embodiment is partitioned into a top portion 70, a middle portion 71, and a bottom portion 72. Each embodiment shows the location of possible inlet openings 60. The inlet openings 60 are located below the top portion 70. The location of the inlet openings 60 assures that the top portion 70 of the conveyance tube(or channel) 21 is always clear of material and that air or other conveying fluids can move through the conveying tube or channel 21.

Those of ordinary skill in the art readily see alternate embodiments of the conveyance tubes which encompass many possible shapes and configurations.

FIG. 8 shows the invention utilized in combination with an abrasive blasting system.

Hopper 20, conveyance tube 21, blast nozzle 80, and blast hose 81 are inside blast room 82. Conveyance tube 21 is in communication with cyclone separator 83, media storage hopper 84, and pressurized blast pot 85. Blast host 81 is connected with blast pot 85. Control mechanism 86 controls media flow and medium pressure in blast hose 81.

This specification has described the preferred embodiment and some alternate embodiments of the invention. This description is for descriptive purposes only and is not intended to limit the scope of the invention. Those of ordinary skill in the art readily recognize many alternate embodiments which incorporate the teachings of this invention and perform substantially the same work, in substantially the same way, to obtain substantially the same result.

It is clear from the foregoing that the present invention represents new and useful improvements in hopper and conveyance tube systems.

What is claimed is:

1. A clog resistant floor recovery system comprising:

a) a hopper having,
   1) at least one side portion,
   2) a bottom portion, and,
   3) at least one outlet opening in to said bottom portion; and, b) a substantially horizontal conveying channel for conveying media from said hopper, said conveying channel having at least one inlet opening for communicating material from said hopper and at a location on said conveying channel means below an uppermost inner surface of said conveying channel.

2. The clog resistant floor recovery system according to claim 1 further comprising a blower, said blower in communication with said conveying channel and inducing fluid flow through said conveying channel.

3. The clog resistant floor recovery system according to claim 2 further comprising a magnet positioned proximate to said at least one outlet opening of said hopper such that metallic particles mixed with said media are retained by said magnet and prevented from exiting through said at least one outlet opening.

4. The clog resistant floor recovery system according to claim 3 wherein said magnet is removably attached to an interior portion of said hopper.

5. The clog resistant floor recovery system according to claim 4 wherein said conveying channel is tube shaped.

6. The clog resistant floor recovery system according to claim 5 further comprising a sweep ramp attached to a rim of said hopper such that a path is provided for conveying media from a floor into said hopper.

7. The clog resistant floor recovery system according to claim 6 further comprising:

a) a vibration inducing device attached to said hopper; and, b) a screen fitted inside said hopper such that said media passes through said screen prior to passing through said at least one outlet opening.

8. A non-clogging hopper apparatus comprising:

a) a receptacle means for the temporary storage of a material, said receptacle means having an outlet opening means for delivery of said material; and, b) a substantially horizontal conveying channel means for conveying said material from said receptacle means, said conveying channel means having an inlet opening means for communicating material from said receptacle means to said conveying channel means, said inlet opening positioned at a location on said conveying channel means below an uppermost inner surface of said conveying channel.

9. The non-clogging hopper apparatus according to claim 8 further comprising magnet means positioned proximate to said outlet opening means for attracting and retaining metallic materials prior to said metallic materials exiting through said outlet opening means.

10. The non-clogging hopper apparatus according to claim 9 further comprising sweep ramp means attached to a rim of said receptacle means for providing a ramp for conveying said material from a floor, up said sweep ramp means, and into said receptacle means.

11. The non-clogging hopper apparatus according to claim 10 wherein said conveying channel means is tube shaped.

12. The non-clogging hopper apparatus according to claim 11 further comprising:

a) vibrator means attached to said receptacle means for vibrating said receptacle means; and, b) screen means interposed between said rim and said outlet opening means of said receptacle means for retaining objects larger than a predetermined size.

13. The non-clogging hopper apparatus according to claim 12 further comprising suction means in communication with said conveying channel means for inducing fluid flow through said conveying channel means.

14. An abrasive blasting facility comprising:

a) an abrasive blasting system having, 1) a blast pot, 2) a blast hose having a first end and a second end, said first end in communication with said blast pot, and, 3) a control mechanism controlling the flow of media and medium into said first end of said blast hose;

b) a blast room enclosing said second end of said blast hose; and, c) a clog resistant floor recovery system having, 1) receptacle means for holding material, said receptacle means having, a) at least one side portion, b) a bottom portion, and, c) an outlet opening positioned in said bottom portion;

2) a substantially horizontal conveying channel means in communication with said blast pot of said abrasive blasting system, said conveying channel means having an inlet opening for communicating material from said receptacle means to said conveying channel means, said inlet opening positioned at a location on said conveying channel means below an uppermost inner surface of said conveying channel;

3) sweep ramp means attached to a rim of said receptacle means for conveying material from a floor, up said sweep ramp, and into said receptacle means;

4) magnet means located proximate to said outlet opening of said receptacle means for retaining metal materials prior to said metal materials exiting through said outlet opening; and, 5) vibration means attached to said receptacle means for vibrating said receptacle means.

* * * * *